US006747918B2

(12) United States Patent
Hight et al.

(10) Patent No.: US 6,747,918 B2
(45) Date of Patent: Jun. 8, 2004

(54) TIMED DRINKING VESSEL

(76) Inventors: Nathaniel L. Hight, 10253 Friendship Ct., Fairfax, VA (US) 22032; Brian P. Trimm, 13137 Country Ridge Dr., Germantown, MD (US) 20874; Thomas S. Reynolds, II, 2665 N. Lake Dr., Milwaukee, WI (US) 53211

( * ) Notice: Subject to any disclaimer, the term of this patent is extended or adjusted under 35 U.S.C. 154(b) by 0 days.

(21) Appl. No.: 10/216,511

(22) Filed: Aug. 9, 2002

(65) Prior Publication Data

US 2003/0031092 A1 Feb. 13, 2003

Related U.S. Application Data

(60) Provisional application No. 60/311,294, filed on Aug. 9, 2001.

(51) Int. Cl.[7] ..... G04B 47/00; G04F 8/00; B65D 77/00

(52) U.S. Cl. ..... 368/10; 368/110; 368/113; 206/217

(58) Field of Search ..... 368/10, 107–113; D10/46.2, 96–97, 101; 206/217

(56) References Cited

U.S. PATENT DOCUMENTS

| | | | | | |
|---|---|---|---|---|---|
| 3,845,883 | A | * | 11/1974 | Johnson et al. | 222/30 |
| 4,400,090 | A | * | 8/1983 | Beroth | 368/9 |
| 4,421,417 | A | * | 12/1983 | McQuade | 368/65 |
| 4,912,687 | A | * | 3/1990 | Treeby | 368/10 |
| 4,939,705 | A | * | 7/1990 | Hamilton et al. | 368/10 |
| D314,308 | S | * | 2/1991 | Cogswell | D7/507 |
| 5,464,092 | A | * | 11/1995 | Seeley | 206/217 |
| D382,173 | S | * | 8/1997 | Cogswell | D7/507 |
| 5,751,660 | A | * | 5/1998 | Chappell | 368/10 |
| 5,802,014 | A | * | 9/1998 | Danko | 368/10 |
| 5,953,288 | A | * | 9/1999 | Chappell | 368/10 |
| 6,588,593 | B2 | * | 7/2003 | Woskoski | 206/459.1 |

* cited by examiner

*Primary Examiner*—David Martin
*Assistant Examiner*—Michael L. Lindinger
(74) *Attorney, Agent, or Firm*—Michael Best & Friedrich LLP

(57) ABSTRACT

A drinking vessel includes a timer coupled to a sidewall of the vessel and having an actuator protruding from the vessel which controls the timer.

12 Claims, 2 Drawing Sheets

TIMED DRINKING VESSEL

CROSS-REFERENCE TO RELATED APPLICATIONS

This application claims priority under 35 U.S.C. § 119 to Provisional Patent Application No. 60/311,294 filed on Aug. 9, 2001 now abandoned.

BACKGROUND AND SUMMARY OF THE INVENTION

The present invention relates to drinking vessels and particularly to single-serving sized vessels, such as mugs, glasses, etc.

Conventional drinking vessels serve as receptacles for beverages. A typical drinking vessel is sized to hold an individual-sized quantity of a beverage. A conventional drinking vessel holds a beverage, but gives no information to the individual drinking the beverage as to his or her rate of consumption. A drinking vessel which automatically monitors the rate at which an individual consumes a beverage would be welcomed by consumers of beverages.

According to the present invention, a drinking vessel includes a stopwatch or timer having an actuator, which controls the functionality of the stopwatch.

In preferred embodiments, a drinking vessel includes a stopwatch or timer and a resting surface. The drinking vessel includes an actuator pin coupled to the stopwatch and protruding from the resting surface. The actuator is movable and starts and stops the stopwatch.

In preferred embodiments, the drinking vessel comprises a mug having a sidewall. The stopwatch includes a visual display coupled to the sidewall of the mug. Additionally, the stopwatch includes a programming panel coupled to the resting surface of the mug, which controls the functionality of the stopwatch (e.g., how the actuator pin starts, stops, resets, etc., the stopwatch).

BRIEF DESCRIPTION OF THE DRAWINGS

The detailed description particularly refers to the accompanying figures in which.

DETAILED DESCRIPTION OF THE DRAWINGS

Figure 1:
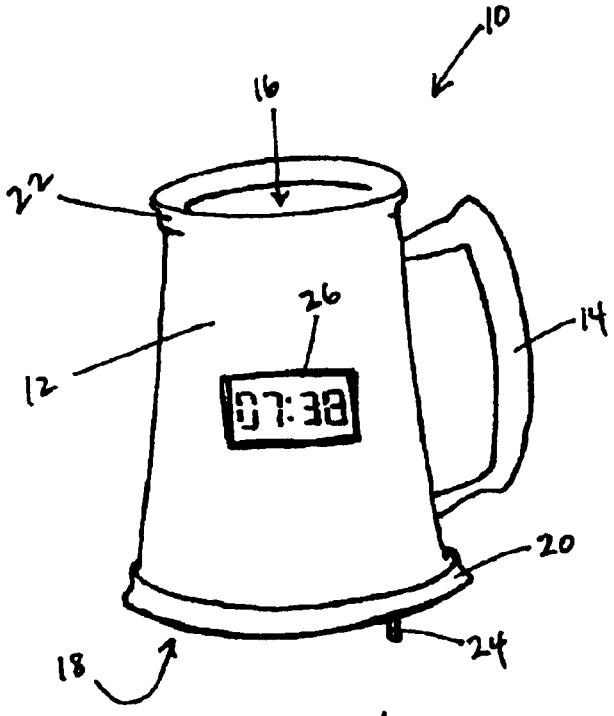
FIG. 1 is a perspective view of a drinking vessel in accordance with the present invention including a stopwatch having a visual display and an actuator pin.

Referring to FIG. 1, a drinking vessel 10 in accordance with the present invention includes a sidewall 12, a handle 14, an interior 16, and a bottom or resting surface 18. Surrounding the bottom or resting surface 18 is a bottom lip 20 and encircling the top of the drinking vessel 10 and providing an opening to the interior 16 is a top lip 22. An actuator pin 24 protrudes from the bottom 18 of the drinking vessel 10 and controls the functionality of a stopwatch having a visual display 26 coupled to the sidewall 12 of the drinking vessel 10.

Figure 2:
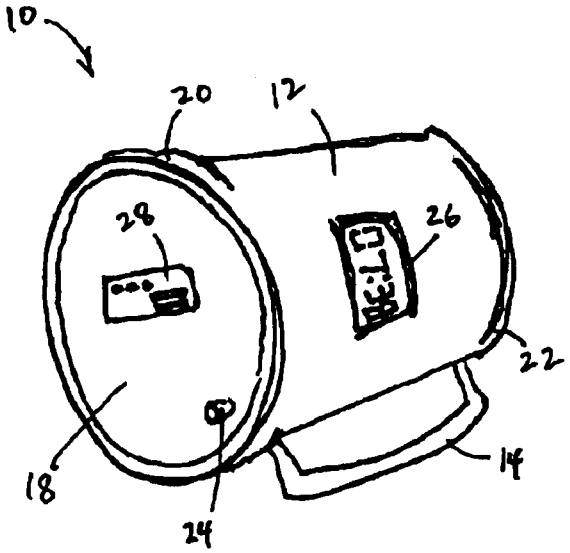
FIG. 2 is a perspective view of the drinking vessel of FIG. 1 illustrating a sidewall and bottom of the drinking vessel and wherein the visual display of the stopwatch is coupled to the sidewall of the drinking vessel and the actuator pin and a programming panel are coupled to the bottom of the drinking vessel.

The stopwatch and its associated visual display 26 allow a user of the drinking vessel 10 to monitor the rate at which he or she consumes a beverage contained within the interior 16 of the drinking vessel 10. The actuator pin 24 controls the stopwatch according to a program input into the stopwatch via a programming panel 28 on the bottom 18 of the drinking vessel 10 (see FIG. 2). The stopwatch can be programmed for many different functionalities as will be readily apparent to those of ordinary skill in the art.

For example, the stopwatch can be programmed to start and stop only once. In this way, when a user lifts the drinking vessel 10 from a support surface (e.g., a table, etc.), the actuator pin 24 further extends from the bottom 18 of the drinking vessel 10 and starts the stopwatch. When the user of the drinking vessel 10 returns the drinking vessel 10 to the support surface, the actuator pin 24 is depressed and is pushed into the bottom 18 of the drinking vessel 10 and stops the stopwatch. In this way, the stopwatch has timed a single drink from, or lifting of, the drinking vessel 10.

In another example, the stopwatch may be programmed using the programming panel 28 to start and stop multiple times. In this way, the drinking vessel 10 can be lifted from and returned to the support surface multiple times, thus depressing and releasing the actuator pin 24 multiple times, to keep track of a total elapsed time of multiple liftings of, or drinks from, the drinking vessel 10. In this example, the stopwatch will only be reset when the user has determined it is appropriate to do so (e.g., when he or she has finished drinking the beverage contained in the drinking vessel 10). The user may reset the stopwatch using the programming panel 28 or multiple quick depressions of the actuator pin 24 according to the particular programming of the stopwatch. According to the first example above, the stopwatch is programmed to time only a single drink from the drinking vessel 10 and, therefore, may be programmed to automatically reset the second time the drinking vessel is lifted from the support surface.

Figure 3:
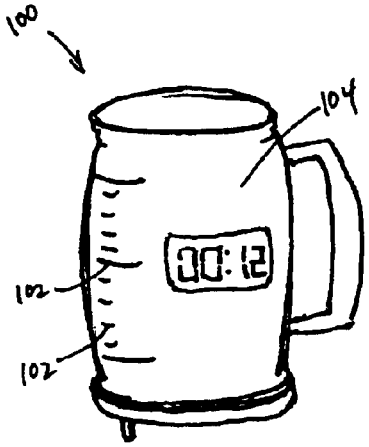
FIG. 3 is another embodiment of a drinking vessel in accordance with the present invention showing a mug having a stopwatch, which includes a visual display and an actuator pin, and wherein a sidewall of the drinking vessel includes a series of measuring indicators.

Referring to FIG. 3, another embodiment of a drinking vessel 100 in accordance with the present invention includes measuring indicator marks 102 on a sidewall 104 of the drinking vessel 100.

Figure 4:
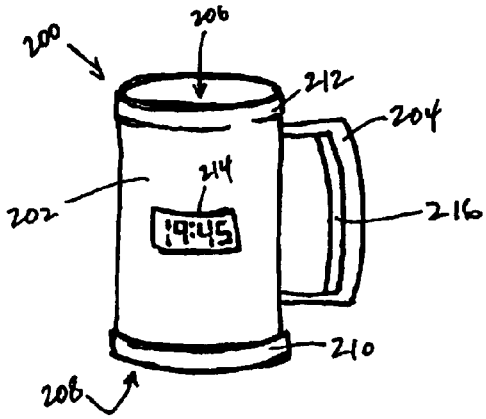
FIG. 4 is a third embodiment of a drinking vessel in accordance with the present invention wherein the drinking vessel includes a stopwatch having a visual display and an actuator formed as part of a handle of the drinking vessel.

Referring to FIG. 4, a drinking vessel 200 in accordance with the present invention includes a sidewall 202, a handle 204, an interior 206 and a bottom or resting surface 208. The bottom 208 is encircled by a lower lip 210, and an upper lip 212 surrounds an opening to the interior 206 of the drinking vessel 200. A visual display 214 of a stopwatch is coupled to the sidewall 202 of the drinking vessel 200 and displays a recorded time of the stopwatch. The stopwatch is actuated by an actuator 216 formed along the inside length of the handle 204 of the drinking vessel 200. In this way, when a user of the drinking vessel 200 grabs the handle 204 of the drinking vessel 200 to take a drink from the drinking vessel 200, he or she starts the stopwatch by depressing the actuator 216. When the user releases his or her hand from the handle

204 of the drinking vessel 200, he or she necessarily releases the actuator 216 and stops the stopwatch, thereby registering an elapsed time on the visual display 214. The exact functionality of the stopwatch can be controlled by a programming panel (not shown) similar to that shown in FIG. 2, as will be readily apparent to those of ordinary skill in the art.

Figure 5:
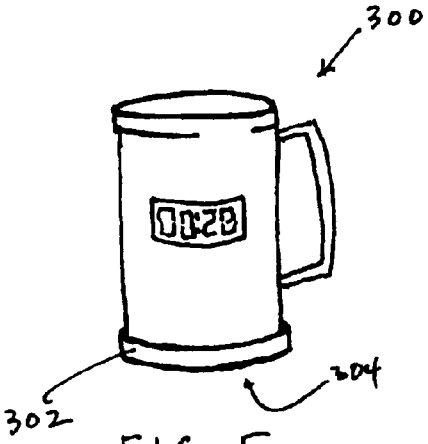
FIG. 5 illustrates a fourth embodiment of a drinking vessel in accordance with the present invention including a stopwatch having a visual display and an actuator formed as part of a bottom lip of the drinking vessel.

Referring to FIG. 5, a drinking vessel 300 in accordance with the present invention, is similar to the drinking vessel 200 shown in FIG. 4 except that instead of including an actuator running along the inside of a handle of the drinking vessel (such as actuator 216, shown in FIG. 4), the drinking vessel 300 includes an actuator 302 formed as a lip or collar around a bottom 304 of the drinking vessel 300. When the drinking vessel 300 is lifted from a support surface, such as a tabletop, etc., the actuator lip or collar 302 extends axially downwardly and starts a stopwatch coupled to the drinking vessel 300. When the user returns the drinking vessel 300 to the support surface, the actuator 302 is depressed axially upwardly by the support surface and the stopwatch is stopped.

Figure 6:
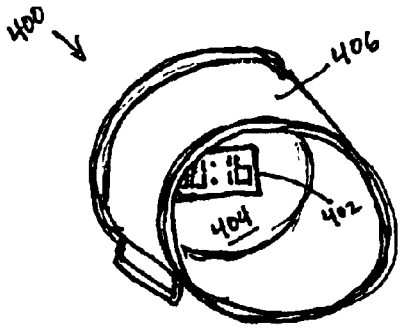
FIG. 6 is a fifth embodiment of a drinking vessel in accordance with the present invention including a stopwatch having a visual display in a floor of the drinking vessel.

Referring to FIG. 6, a drinking vessel 400 in accordance with the present invention is similar to drinking vessels 10, 100, 200, and 300 except a visual display 402 is included on a floor 404 of the drinking vessel 400 instead of on its sidewall 406, as is the case with drinking vessels 10, 100, 200, and 300.

Although the invention has been described in detail with reference of certain preferred embodiments, variations and modifications exist within the scope and spirit of the invention as described above.

What is claimed is:

1. A drinking vessel comprising:

a mug having a sidewall and a resting surface, a stopwatch coupled to the mug and including a visual display coupled to the sidewall, and an actuator pin protruding from the resting surface, wherein the actuator pin controls the stopwatch.

2. The drinking vessel of claim 1, wherein the mug includes a handle, the handle comprising a second actuator which controls the stopwatch.

3. The drinking vessel of claim 1, wherein the mug includes a bottom lip, the bottom lip comprising a second actuator which controls the stopwatch.

4. A drinking vessel comprising:

a vessel having a handle, a stopwatch coupled to the vessel and including a visual display mounted to the vessel, and an actuator mounted to the handle and wherein the actuator controls the stopwatch when the vessel is picked up by the handle.

5. The drinking vessel of claim 4, wherein the visual display is mounted to a sidewall of the vessel.

6. The drinking vessel of claim 4, wherein the visual display is mounted to a floor of the vessel.

7. The drinking vessel of claim 4, wherein the actuator is a pin.

8. A drinking vessel comprising:

a drinking container having a sidewall and a resting surface, a timer coupled to the container and including a visual display coupled to the sidewall, and an actuator pin protruding from the resting surface and controlling the timer.

9. The drinking vessel of claim 8, wherein the container includes a handle, the handle comprising a second actuator which controls the timer.

10. The drinking vessel of claim 8, wherein the container includes a bottom lip, the bottom lip comprising a second actuator which controls the timer.

11. The drinking vessel of claim 8, wherein the visual display is a digital display.

12. The drinking vessel of claim 8, wherein the visual display is an analog display.

* * * * *